US005899835A

United States Patent [19]

Puranda

[11] Patent Number: 5,899,835

[45] Date of Patent: May 4, 1999

[54] MULTIFUNCTIONAL TRAINING DEVICE

[76] Inventor: Dennis C. Puranda, 129-51 134th St., South Ozone Park, N.Y. 11420

[21] Appl. No.: 08/958,036

[22] Filed: Oct. 27, 1997

[51] Int. Cl.[6] ..... A63B 69/36

[52] U.S. Cl. ..... 482/90; 482/83; 482/87

[58] Field of Search ..... 482/83, 87, 90; 472/441, 445

[56] References Cited

U.S. PATENT DOCUMENTS

| | | | |
|---|---|---|---|
| 2,085,161 | 6/1937 | Kraus | 482/90 |
| 4,077,624 | 3/1978 | Feaser . | |
| 4,434,980 | 3/1984 | Babineaux . | |
| 4,564,194 | 1/1986 | Lebowitz . | |
| 4,681,318 | 7/1987 | Lay | 482/90 |
| 5,046,724 | 9/1991 | Sotomayer . | |

FOREIGN PATENT DOCUMENTS

| | | | |
|---|---|---|---|
| 3203044 | 11/1982 | Germany | 482/90 |

*Primary Examiner*—Jerome Donnelly
*Attorney, Agent, or Firm*—Michael I. Kroll

[57] ABSTRACT

A multifunctional training device (10) comprising a base (12) adapted to be placed upon a horizontal support surface (14). A stanchion (16) is also provided. A main coil spring (18) has two ends (20) and (22). The first end (20) is fixedly attached to the base (12), while the second end (22) is fixedly attached to the stanchion (16). A body bag unit (24) is removably attachable onto the stanchion (16) to receive strikes from a trainee. A punching bag striking unit (26) is removably attachable onto a top end (28) of the stanchion (16) to receive strikes from the trainee.

31 Claims, 9 Drawing Sheets

48
52
50
26
58
28
54
24
10
10
44
16
22
46
18

60
44
16
56
20a
46
22
18
2b
40
20
36
12
42
38
34

18
40
20
12
36

(SPRING IMMOBILIZER FOR USE WITH "T" BAR)

MULTIFUNCTIONAL TRAINING DEVICE

DESCRIPTION OF THE PRIOR ART

Numerous striking apparatuses have been provided in prior art. For example, U.S. Pat. Nos. 4,077,624 to Feaser; 4,434,980 to Babineaux; 4,564,192 to Lebowitz and 5,046,724 to Sotomayer all are illustrative of such prior art. While these units may be suitable for the particular purpose to which they address, they would not be as suitable for the purposes of the present invention as heretofore described.

Feaser, David D.

Striking Device for Training in Martial Arts

U.S. Pat. No. 4,077,624

A striking device for use by a trainee in karate, boxing, etc., to simulate an opponent. Target elements are suspended by a cord from a fixed overhead position and pivoted rod-mounted response elements are balanced between the target elements. When the trainee strikes the target elements, the response elements move in an unpredictable manner to strike back at the trainee.

Babineauxe Bernard J.

Boxing Device that Fights Back

U.S. Pat. No. 4,434,980

A boxing device that fights back is disclosed which comprises a coupling suspendable from rigid upper supporting structure, a resilient boxing bag suspended from the coupling and attachable to rigid lower supporting structure, and a pair of arms with their upper ends attached to the coupling and their lower ends free to swing arcutately forward and upward towards an attacker in response to the attacker's blows upon the resilient boxing bag. A second resilient boxing bag, also attachable to the rigid lower supporting structure, may be suspended below the first bag.

Lebowitz, Leizer

Partial Arts Training Apparatus and Method

U.S. Pat. No. 4,564,192

A training apparatus and method for training a martial arts student. A pair of simulated limbs are designed to strike blows against the student in a way that requires great skill on the part of the student to defend against the blows. The blows are directed at the student with considerable force, and from a variety of different angles, thus requiring great dexterity on the part of the student to defend against the blow. The limb members are supported in a way that allows them many degrees of movement. Specifically, the limb members are each connected for universal movement relative to a support. In addition, each of the limb members can pivot relative to the means that connects it for universal movement relative to the support. Still further, the support itself has several degrees of movement to provide additional ranges of movement for the limb members. A spring arrangement resiliently biases the limb members towards a neutral position relative to a student positioned in a striking area. The spring arrangement allows one limb member to recoil relative to the other limb member when a blow is delivered against the one limb member from the striking area. The spring arrangement is designed so that when the one limb member recoils, it applies a resilient follow-up force to the other limb member that causes the other limb member to strike a return blow at a student in the striking area.

First boxers boxing bag. Such device provides unexpected response to another fighter's punches simulating movements of opponent boxers in a boxing or sparing match. In addition, the invention may be utilized by a single boxer, in which case, it responds similarly to presently commonly available punching bags.

SUMMARY OF THE INVENTION

A primary object of the present invention is to provide a multifunctional training device that will overcome the shortcomings of the prior art devices.

Another object is to provide a multifunctional training device that is specialized equipment which functions as a complete workout system, to be utilized by a trainee in the martial arts, boxing and kick boxing fields, so that the trainee can use maximum force without inflicting injury to another person.

An additional object is to provide a multifunctional training device in which interchangeable components are capable of transforming the device into other types of exercise equipment to be used by the trainee for conditioning purposes.

A further object is to provide a multifunctional training device that is simple and easy to use.

A still further object is to provide a multifunctional training device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figures 2, 2A, 2B:
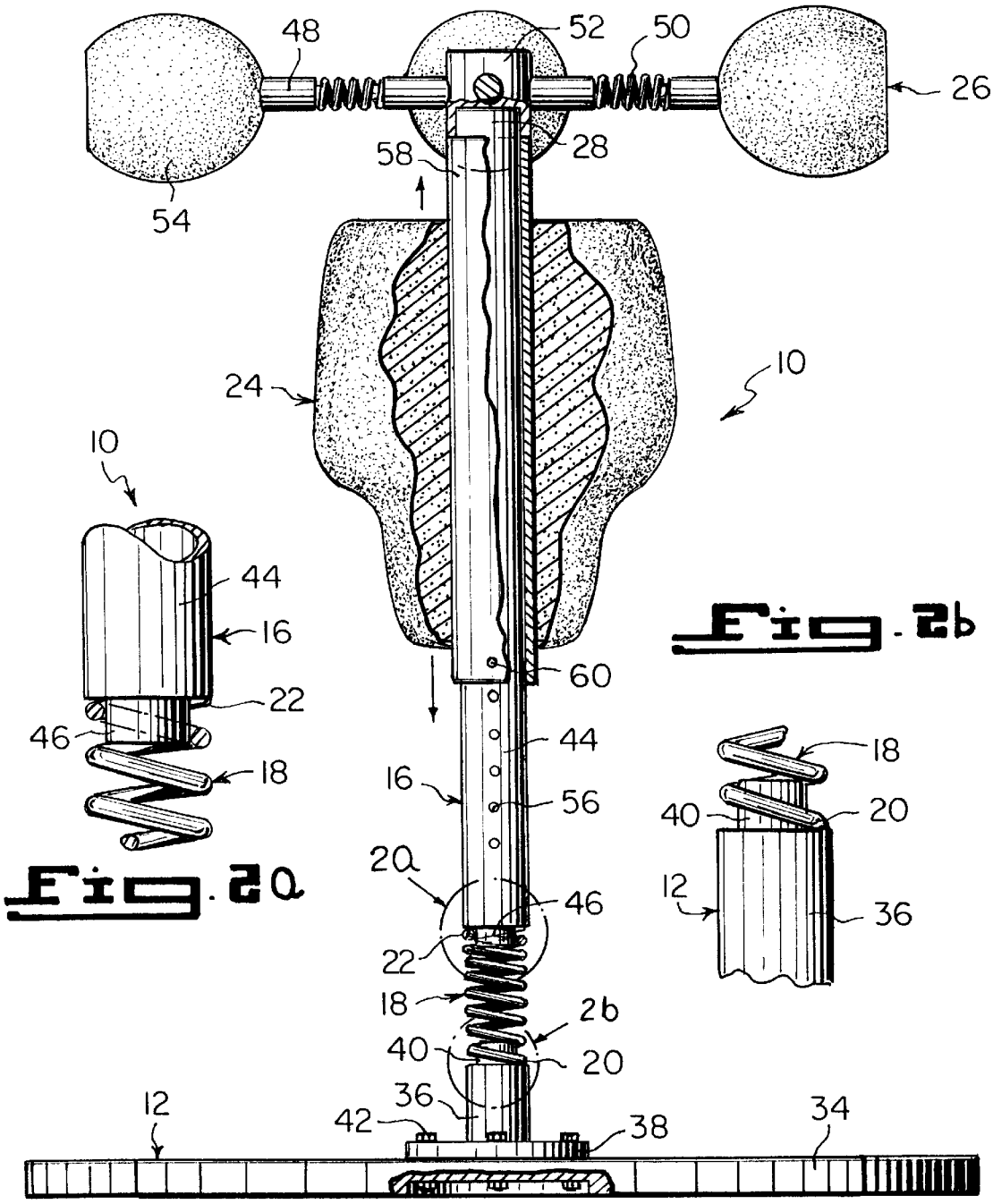
FIG. 2 is an elevational view taken in the direction of arrow 2 in FIG. 1, with parts broken away and in section.

FIG. 2*a* is an enlarged elevational view of an area in FIG. 2, as indicated by arrow 2*a*.

FIG. 2*b* is an enlarged elevational view of an area in FIG. 2, as indicated by arrow 2*b*.

Figure 3:
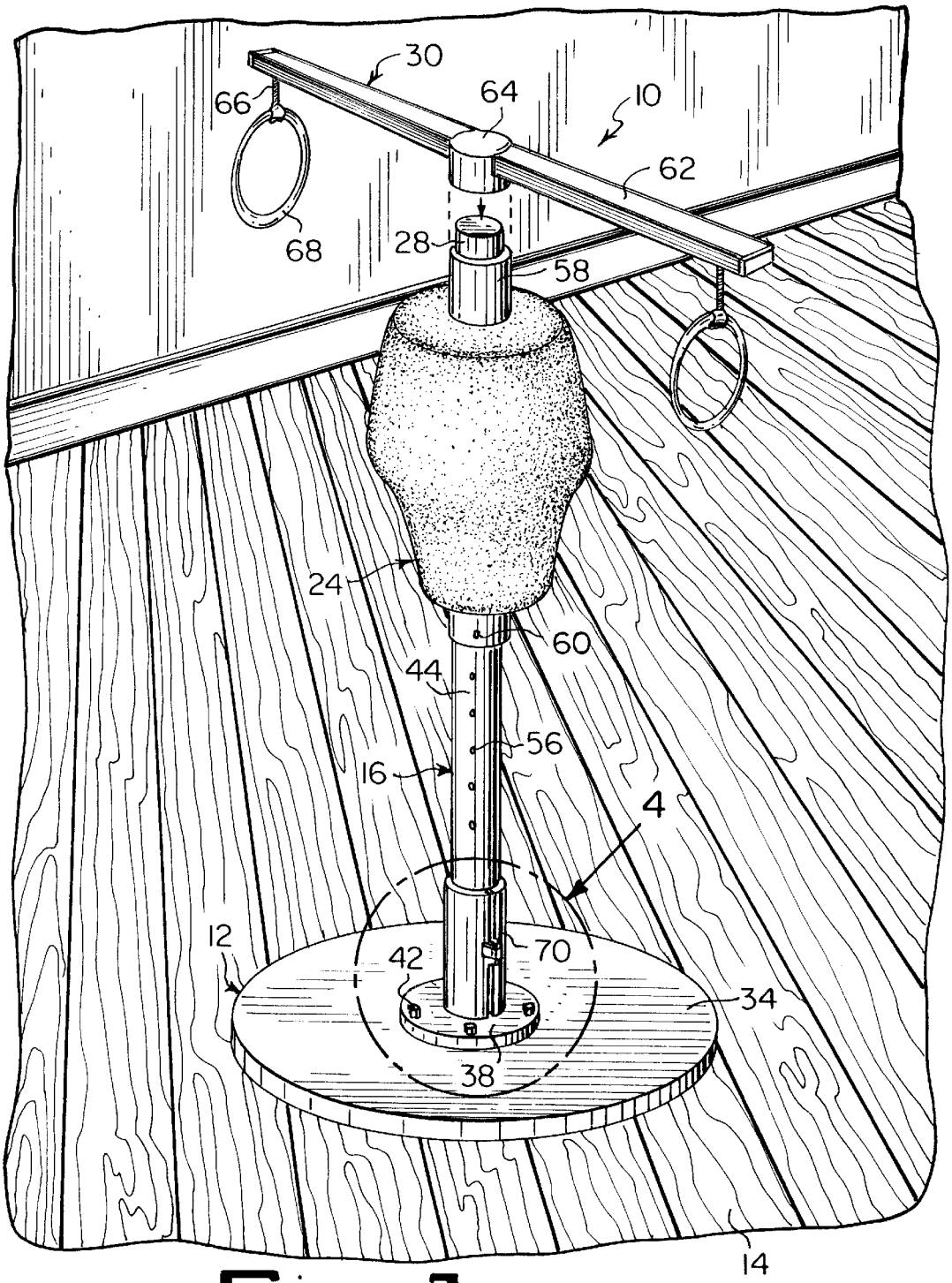

FIG. 3 is a perspective view of the first embodiment with a T-bar unit ready to be installed thereon.

Figure 4:
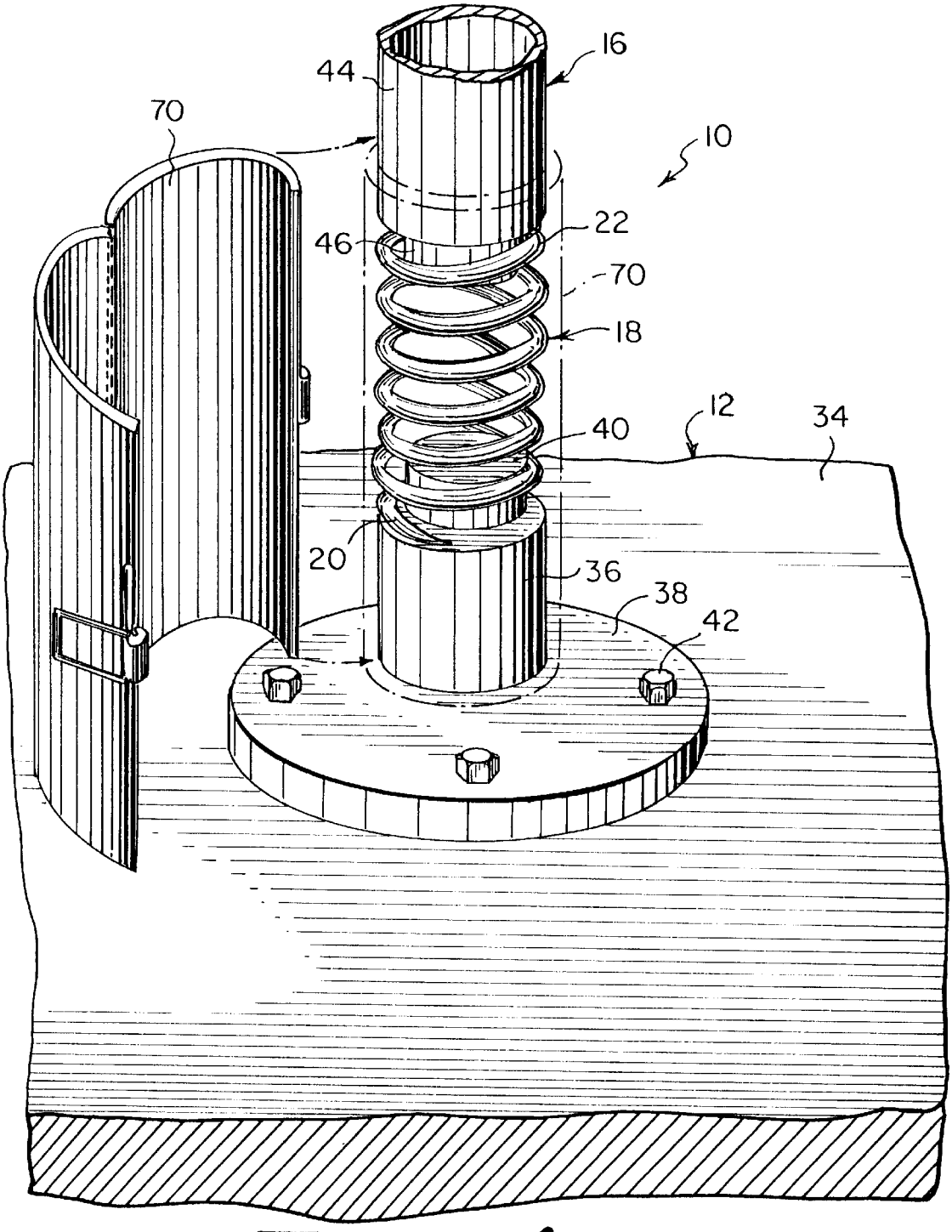

FIG. 4 is an enlarged perspective view of an area in FIG. 3, as indicated by arrow 4, showing the spring immobilizer ready to be installed thereto.

Figure 5:
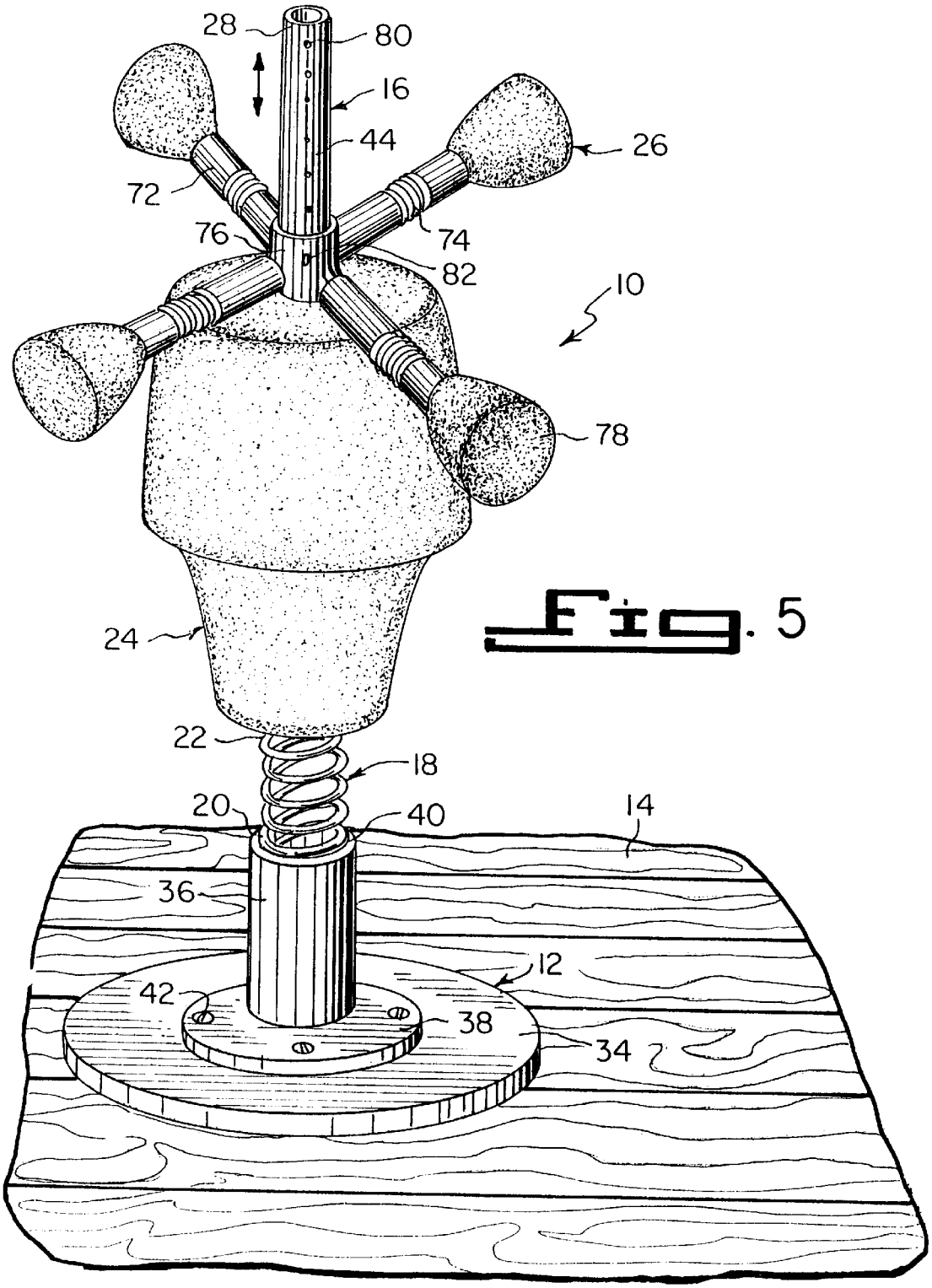

FIG. 5 is a perspective view of a second embodiment of the present invention with a modified punching bag striking unit of four pieces attached thereon.

Figure 6:
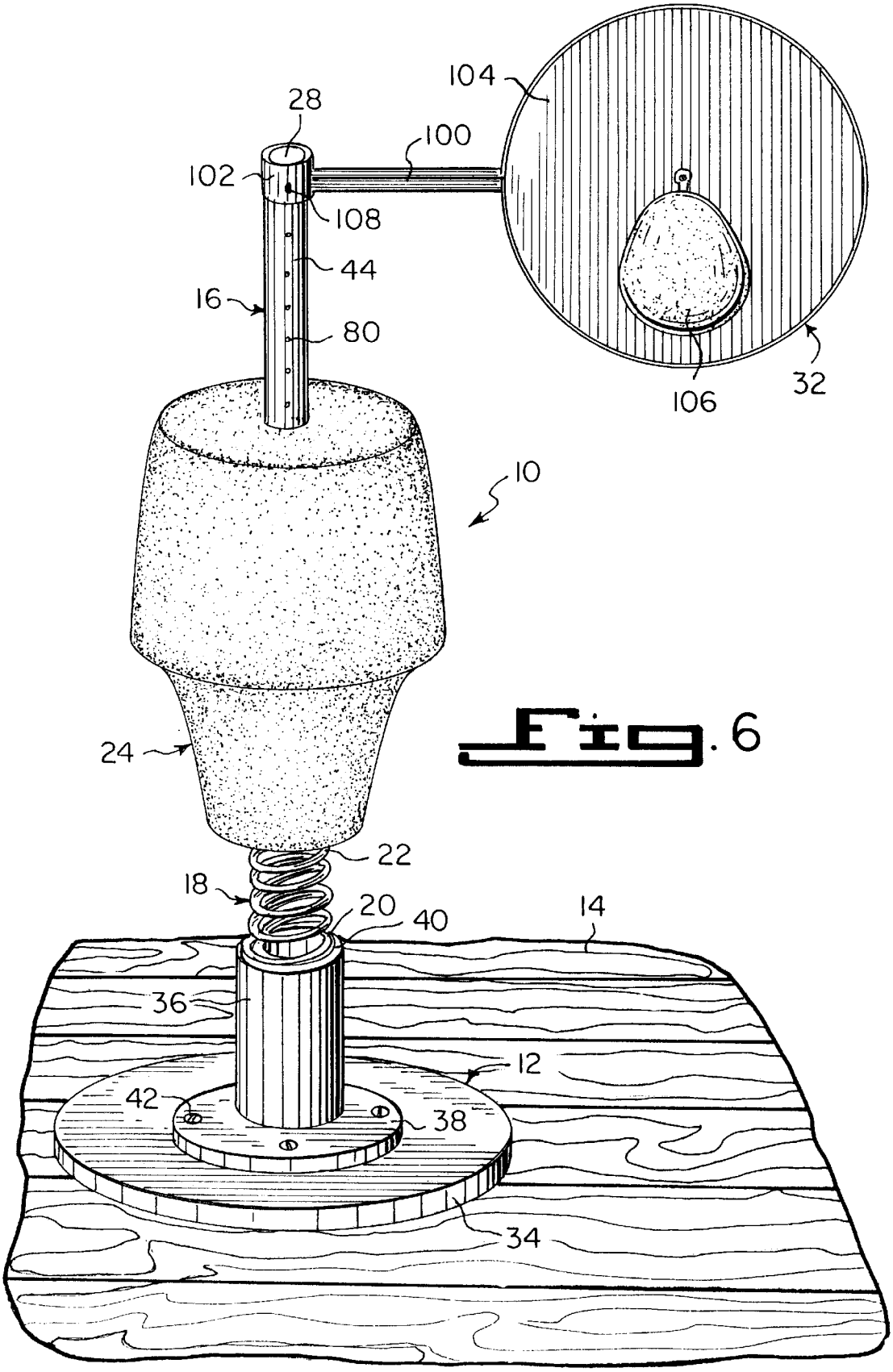

FIG. 6 is a perspective view of the second embodiment with a speed bag striking unit attached thereon.

Figure 7:
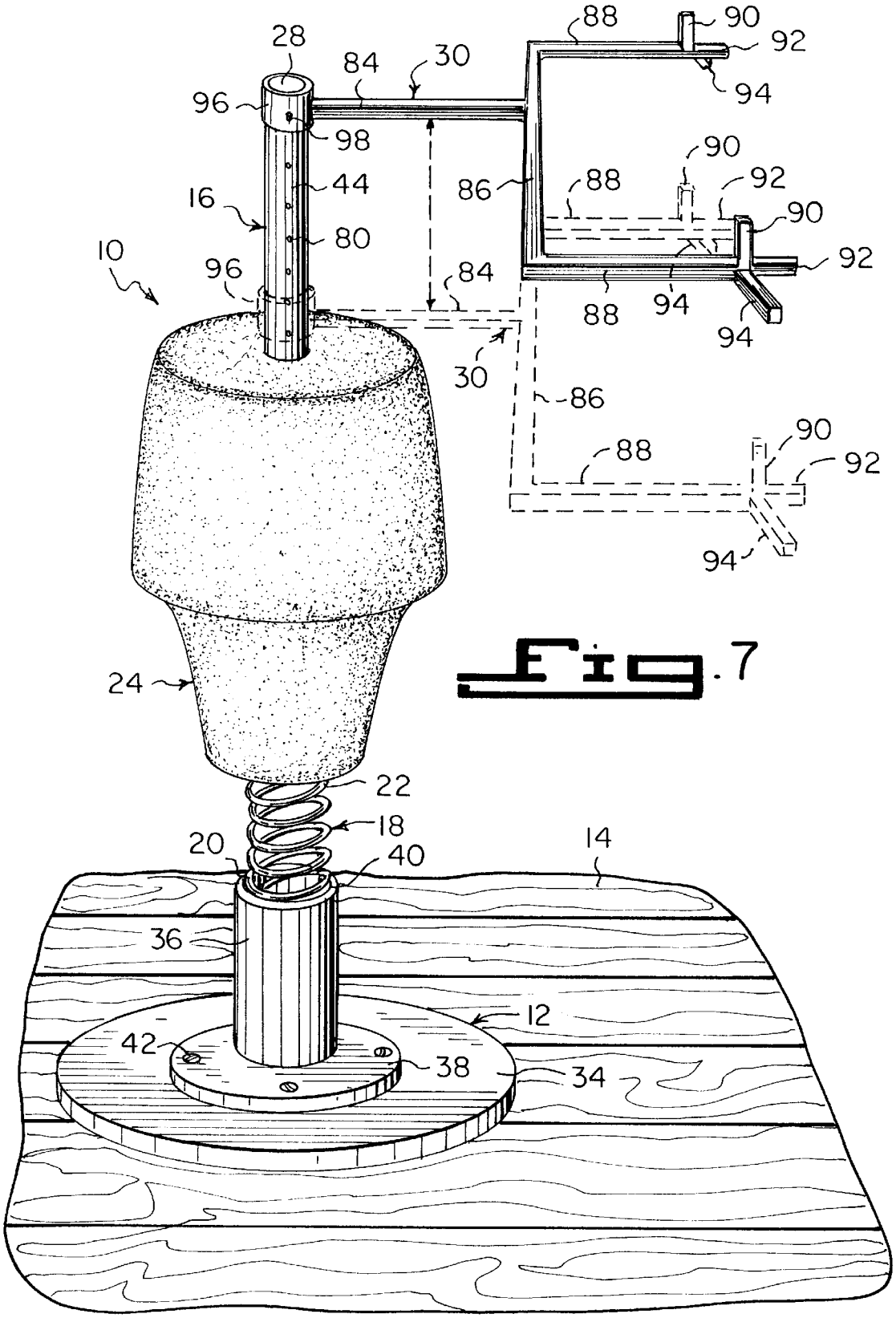

FIG. 7 is a perspective view of the second embodiment with an alternate T-bar unit attached thereon.

Figure 8:
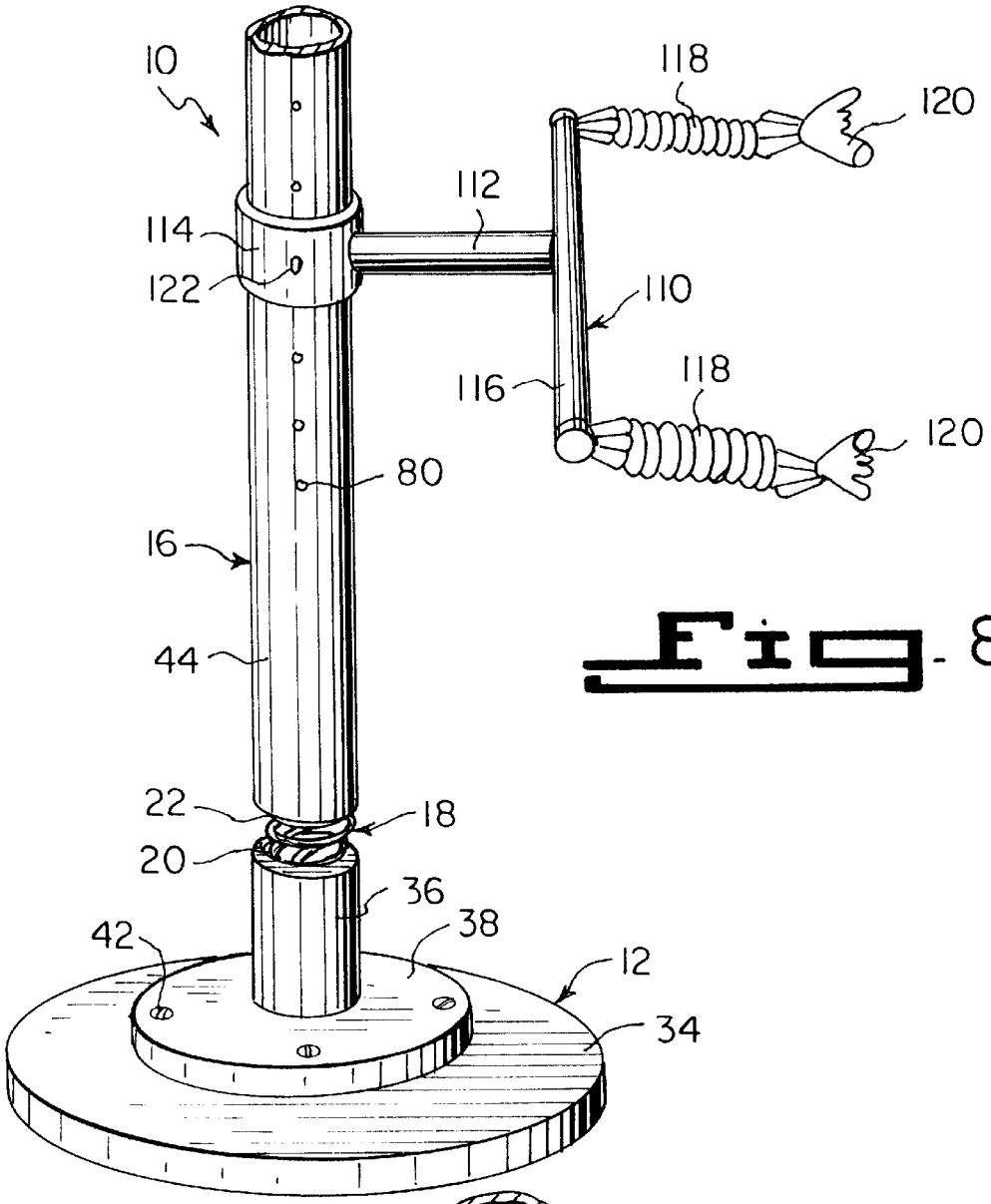

FIG. 8 is a perspective view of the second embodiment with parts broken away, the body bag unit removed and a shadow boxing strength trainer unit attached thereon.

Figure 9:
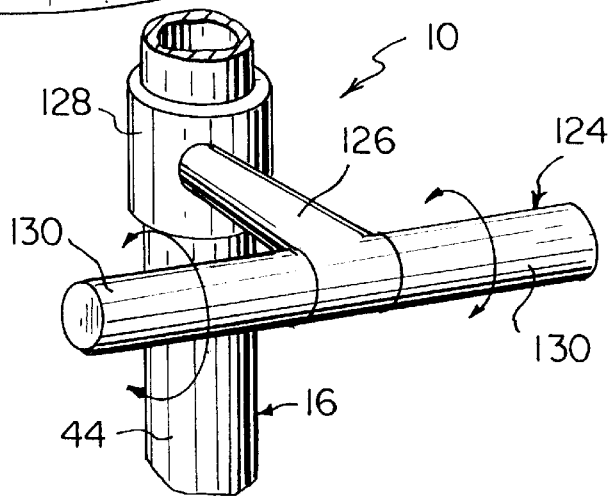

FIG. 9 is a perspective view of a portion of the stanchion of the second embodiment with a wrist and forearm strengthener unit attached thereon.

Figure 10:
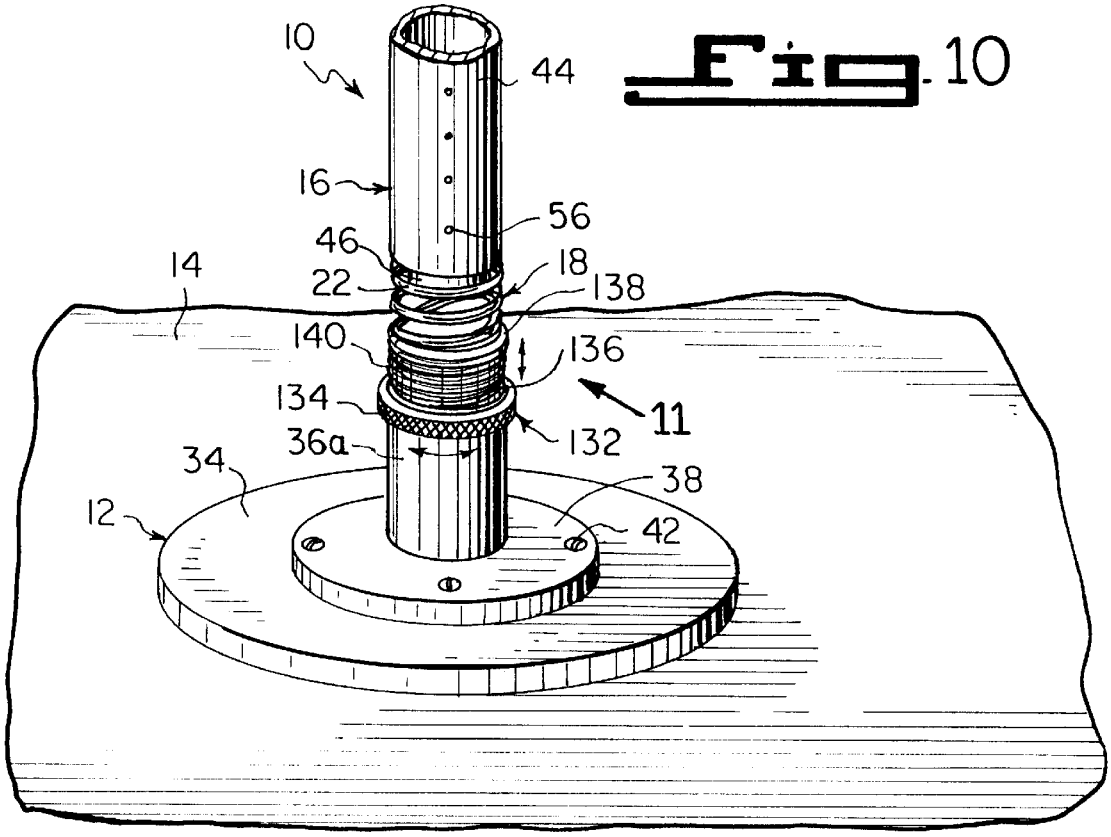

FIG. 10 is an enlarged perspective view similar to FIG. 4, showing a tension adjuster for the main coil spring.

Figure 11:
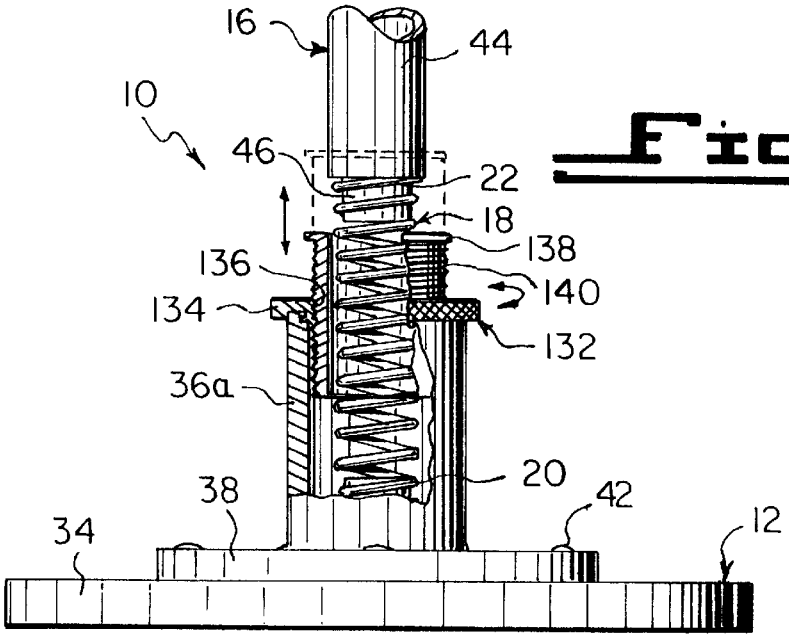

FIG. 11 is an elevational view taken in the direction of arrow 11 in FIG. 10, with parts broken away and in section.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views FIGS. 1 through 11 illustrate the present invention being a multifunctional training device 10. With regard to the reference numerals used, the following numbering is used throughout the various drawing figures.

| | |
|---|---|
| 10 | multifunctional training device |
| 12 | base of 10 |
| 14 | horizontal support surface |
| 16 | stanchion of 10 |
| 18 | main coil spring of 10 |
| 20 | first end of 18 |
| 22 | second end of 18 |
| 24 | body bag unit of 10 |
| 26 | punching bag striking unit of 10 |
| 28 | top end of 16 |
| 30 | T-bar unit of 10 |
| 32 | speed bag unit of 10 |
| 34 | platform of 12 |
| 36 | stub post of 12 |
| 36a | hollow stub post of 12 |
| 38 | mounting flange on 36 |
| 40 | top annular seat on 36 |
| 42 | fastener of 12 |
| 44 | elongate cylindrical pipe for 16 |
| 46 | bottom annular seat of 16 |
| 48 | arm of 26 |
| 50 | coil spring of 26 |
| 52 | cap of 26 |
| 54 | punching bag of 26 |
| 56 | adjustment hole in 16 |
| 58 | elongate sleeve in 24 |
| 60 | lock pin in 58 |
| 62 | arm of 30 |
| 64 | cap of 30 |
| 66 | flexible cord of 30 |
| 68 | ring of 30 |
| 70 | spring immobilizer of 30 |
| 72 | arm of 26 |
| 74 | coil spring of 26 |
| 76 | collar of 26 |
| 78 | punching bag of 26 |
| 80 | adjustment hole in 16 |
| 82 | lock pin of 26 in 76 |
| 84 | arm of 30 |
| 86 | forked end of 84 |
| 88 | prong of 86 |
| 90 | first hand grip on 88 |
| 92 | second hand grip on 88 |
| 94 | third hand grip on 88 |
| 96 | collar of 30 |

-continued

| | |
|---|---|
| 98 | lock pin of 30 in 96 |
| 100 | arm of 32 |
| 102 | collar of 32 |
| 104 | back board of 32 on 100 |
| 106 | speed bag of 32 on 104 |
| 108 | lock pin of 32 in 102 |
| 110 | show boxing strength trainer unit of 10 |
| 112 | arm of 110 |
| 114 | collar of 110 |
| 116 | cross bar of 110 |
| 118 | elastic expansion cord of 110 |
| 120 | half shaped glove of 110 |
| 122 | lock pin of 110 in 114 |
| 124 | wrist and forearm strengthener unit of 10 |
| 126 | arm of 124 |
| 128 | collar of 124 |
| 130 | lock pin of 124 (not shown) |
| 132 | tension adjuster for 18 |
| 134 | knurled collar of 132 |
| 136 | internally threaded aperture in 134 |
| 138 | spring support collar of 132 |
| 140 | externally threaded circumference of 138 |

The multifunctional training device 10 comprises a base 12 adapted to be placed upon a horizontal support surface 14, such as a floor. A stanchion 16 is provided. A main coil spring 18 has two ends 20 and 22. The first end 20 is fixedly attached to the base 12, while the second end 22 is fixedly attached to the stanchion 16. A body bag unit 24 is removably attachable onto the stanchion 16, to receive strikes from a trainee. A punching bag striking unit 26 is removably attachable onto a top end 28 of the stanchion 16, to receive strikes from the trainee.

A T-bar unit 30 is removably attachable onto the top end 28 of the stanchion 16, so that the trainee can do pull-up exercises for the chest and backs. A speed bag unit 32 is also removably attachable onto the top end 28 of the stanchion 16, to receive punches from the trainee.

The base 12 includes a platform 34 which sits upon the horizontal support surface 14. A stub post 36 has a mounting flange 38 at a bottom end and an annular seat 40 at a top end. A plurality of fasteners 42 affix the mounting flange 38 centrally to the platform 34, so that the top annular seat 40 can be fixedly attached to the first end 20 of the main coil spring 18.

The stanchion 16 is an elongate cylindrical pipe 44 having an annular seat 46 at a bottom ends so that the bottom annular seat 46 can be fixedly attached to the second end 22 of the main coil spring 18. The body bag unit 24 is curved in shape similar to a human torso with sides, back and front being identical, to give better leverage to the trainee with uppercuts and hooks to the body, unlike a traditional rounded body bag.

Figure 1:
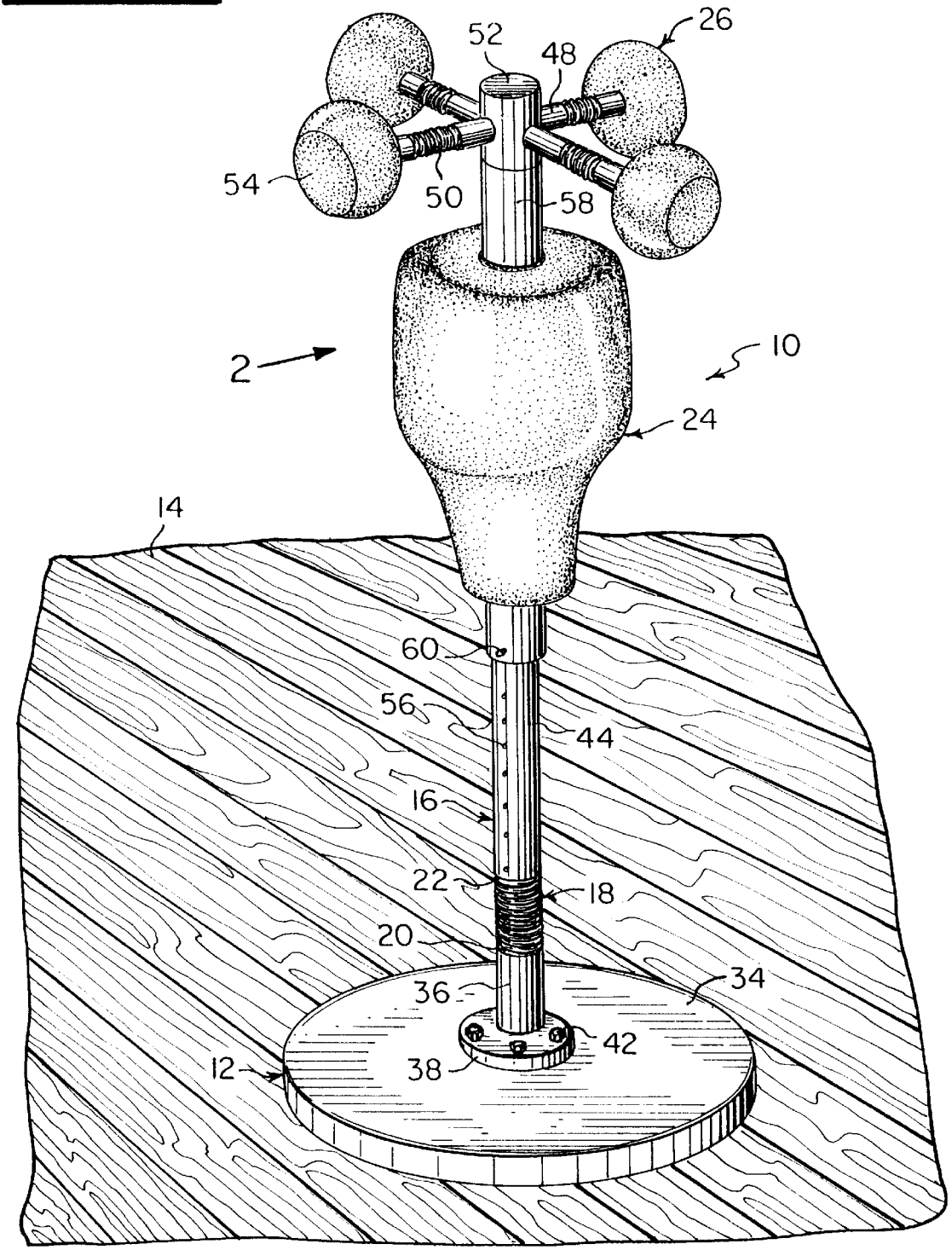
FIG. 1 is a perspective view of a first embodiment of the present invention with a punching bag striking unit attached thereon.

The punching bag striking unit 26, as shown in FIGS. 1 and 2, consists of a plurality of arms 48. A plurality of coil springs 50 are provided, wherein each coil spring 50 is intermediately carried in each arm 48. A cap 52 is sized to fit upon the top end 28 of the stanchion 16, for securing in a removable manner the arms 48 radially about the top end 28 of the stanchion 16. A plurality of punching bags 54 are provided. Each punching bag 54 is attached to a distal free end of each arm 48, to allow for flexibility and freedom of movement for the trainee around the punching bag striking unit 26, providing the impression of an opponent's head being available at all angles, which when struck imitates natural head movements.

The stanchion 16 has a plurality of longitudinally spaced apart adjustment holes 56. An elongate sleeve 58 extends centrally through the body bag unit 24 and is affixed thereto. The elongate sleeve 58 can slide upon the stanchion 16. A lock pin 60 in the elongate sleeve 58 can engage with any one of the adjustment holes 56, so as to adjust the height of the body bag unit 24 with respect to the stanchion 16 to accommodate the trainee. The body bag unit 24 is also removable, so that each of the other units can be used without the body bag unit 24 being attached onto the stanchion 16.

The T-bar unit 30, as shown in FIG. 3, comprises a pair of arms 62. A cap 64 sized to fit upon the top end 28 of the stanchion 16 is for securing in a removable manner the arms 62 in an opposed position radially about the top end 28 of the stanchion 16. A pair of flexible cords 66 are provided. Each flexible cord 66 will hang down from a distal free end of each arm 62. A pair of rings 68 are also provided, whereby each ring 68 is affixed to one flexible cord 66. A spring immobilizer 70 fits about the main coil spring 18, to maintain the stanchion 16 in a vertical upright stationary position, to allow the trainee to use the T-bar unit 30 safely.

The punching bag striking unit 26, as shown in FIG. 5, includes a plurality of arms 72. A plurality of coil springs 74 are provided. Each coil spring 74 is intermediately carried in each arm 72. A collar 76 sized to fit over the top end 28 of the stanchion 16, is for holding in a removable manner the arms 72 radially about the stanchion 16. A plurality of punching bags 78 are provided. Each punching bag 78 is attached to a distal free end of each arm 72, to allow for flexibility when each punching bag 78 is struck by the trainee. The stanchion 16 has a plurality of longitudinally spaced apart adjustment holes 80. A lock pin 82 is in the collar 76 which can engage with any one of the adjustment holes 80, so as to adjust the height of the punching bags 78 with respect to the stanchion 16 to accommodate the trainee.

The T-bar unit 30, shown in FIG. 7, contains an arm 84 having a forked end 86 with two prongs 88 and three hand grips 90, 92, 94 on each prong 88. The first hand grip 90 faces upward, the second hand grip 92 faces directly ahead and the third hand grip 94 faces outward. A collar 96 sized to fit over the top end 28 of the stanchion 16, is for holding in a removable manner the arm 84 horizontally out from the stanchion 16. The stanchion 16 has the plurality of longitudinally spaced apart adjustment holes 80. A lock pin 98 in the collar 96 can engage with any one of the adjustment holes 80, so as to adjust the height of the hand grips 90, 92, 94 with respect to the stanchion 16 to accommodate the trainee. When the collar 96 is retained in a lower position on the stanchion 16, as shown in dotted lines, the trainee can do leg raise and dip exercises for chest and triceps. When the collar 96 is retained in an upper position on the stanchion 16 the trainee can do biceps, shoulder and back pull-ups.

The speed bag unit 32 shown in FIG. 6, comprises an arm 100. A collar 102 sized to fit over the top end 28 of the stanchion 16, is for holding in a removable manner the arm 100 horizontally out from the stanchion 16. A back board 104 is vertically affixed to a distal free end of the arm 100. A speed bag 106 is suspended on the back board 104. The stanchion 16 has the plurality of longitudinally spaced apart adjustment holes 80. A lock pin 108 in the collar 102 can engage with any one of the adjustment holes 80, so as to adjust the height of the speed bag 106 with respect to the stanchion 16 to accommodate the trainee.

A shadow boxing strength trainer unit 110, shown in FIG. 8, is removably attachable onto the stanchion 16, so that the trainee can do arm extenuation exercises both for direct forward, extend downward and upward arm flex exercises, so as to primarily imitate shadow boxing movements instead of simply punching at wind. The shadow boxing strength trainer unit 110 consists of an arm 112. A collar 114 is sized to fit over a top end of the stanchion 16, for holding in a removable manner the arm 112 horizontally out from the stanchion 16. A cross bar 116 is transversely affixed to a distal free end of the arm 112. A pair of elastic expansion cords 118 are provided Each cord 118 is affixed at a first end and at a right angle to one end of the cross bar 112. A pair of half shaped gloves 120 are also provided. Each glove 120 is affixed to a second end of one cord 118 to be engaged by the trainee. The stanchion 16 has a plurality of longitudinally spaced apart adjustment holes 80. A lock pin 122 in the collar 114 can engage with any one of the adjustment holes 80, so as to adjust the height of the gloves 120 on the cords 118, to accommodate the trainee.

A wrist and forearm strengthener unit 124 shown in FIG. 9, is removably attachable onto the stanchion 16 that will enable the trainee to strengthen the wrists and forearms. The wrist and forearm strengthener unit 124 includes an arm 126. A collar 128 is sized to fit over a top end of the stanchion 16, for holding in a removable manner the arm 126 horizontally out from the stanchion 16. A pair of spring biased rotatable hand grips 130 are transversely affixed to a distal free end of the arm 126 to be gripped and turned forward and backward by the trainee. The stanchion 16 has a plurality of the longitudinally spaced apart adjustment holes 80. A lock pin 130 (not shown) in the collar can engage with any one of the adjustment holes 80, so as to adjust the height of the hand grips 130, to accommodate the trainee.

The multifunctional training device 10, shown in FIGS. 10 and 11, can further include a tension adjuster 132 for the main coil spring 18, so as to control movement of the stanchion 16 with respect to the base 12. The tension adjuster 132 contains a knurled collar 134 rotatively carried on a top end of a hollow stub post 36*a* of the base 12. The knurled collar 134 has an internally threaded aperture 136. A spring support collar 138 has an externally threaded circumference 140, that threads into the knurled collar 134. When the knurled collar 134 is turned it will raise and lower the spring support collar 138 to effectively increase and reduce spring action of the main coil spring 18, which extends into the hollow stub post 36*a*.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multifunctional training device in kit form comprising:

a) a base adapted to be placed upon a horizontal support surface;

b) a stanchion;

c) a main coil spring having two ends, in which said first end is fixedly attached to said base, while said second end is fixedly attached to said stanchion;

d) a body bag unit removably attachable onto said stanchion to receive strikes from a trainee;

e) a punching bag striking unit removably attachable onto a top end of said stanchion to receive strikes from the trainee.

f) a T-bar unit removably attachable onto a top end of said stanchion so that the trainee can do pull-up exercises for the chest and back; and g) a spring immobilizer which fits about said main coil spring to maintain said stanchion in a vertical upright stationary position, to allow the trainee to use said T-bar unit safely.

2. A multifunctional training device in kit form as recited in claim 1, further including a speed bag unit removably attachable onto a top end of said stanchion to receive punches from the trainee.

3. A multifunctional training device in kit form as recited in claim 1, wherein said base includes:

a) a platform which sits upon the horizontal support surface;

b) a stub post having a mounting flange at a bottomed and an annular seat at a top end; and c) a plurality of fasteners to affix said mounting flange centrally to said platform, so that said top annular seat can be fixedly attached to said first end of said main coil spring.

4. A multifunctional training device in kit form as recited in claim 1, wherein said stanchion is an elongate cylindrical pipe having an annular seat at a bottom end, so that said bottom annular seat can be fixedly attached to said second end of said main coil spring.

5. A multifunctional training device in kit form as recited in claim 1, wherein said body bag unit is curved in shape similar to a human torso with sides, back and front being identical, to give better leverage to the trainee with upper cuts and hooks to the body, unlike a traditional rounded body bag.

6. A multifunctional training device in kit form as recited in claim 1, wherein said punching bag striking unit includes.

a) a plurality of arms;

b) a plurality of coil springs, wherein each said coil spring is intermediately carried in each said arm;

c) a cap sized to fit upon at top end of said stanchion for securing in a removable manner said arms radially about the top end of said stanchion; and d) a plurality of punching bags, wherein each said punching bag is attached to a distal free end of each said arm, to allow for flexibility and freedom of movement for the trainee around said punching bag striking unit, providing the impression of an opponent's head being available at all angles, which when struck, imitates natural head movements.

7. A multifunctional training device in kit form as recited in claim 1, further including:

a) said stanchion having a plurality of longitudinally spaced apart adjustment holes;

b) an elongate sleeve extending centrally through said body bag unit and affixed thereto whereby said elongate sleeve can slide upon said stanchion; and c) a lock pin in said elongate sleeve which can engage with any one of said adjustment holes, so as to adjust the height of said body bag unit with respect to said stanchion to accommodate the trainee, said body bag unit is also removable, so that each of said other units can be used without said body bag unit being attached on to said stanchion.

8. A multifunctional training device in kit form as recited in claim 1, wherein said T-bar unit includes:

a) a pair of arms;

b) a cap sized to fit upon a top end of said stanchion for securing in a removable manner said arms in an opposed position radially about the top end of said stanchion;

c) a pair of flexible cords, whereby each said flexible cord will hang down from a distal free end of each said arm and;

d) a pair of rings, whereby each said ring is affixed to one said flexible cord.

9. A multifunctional training device in kit form as recited in claim 1, wherein said punching bag striking unit includes:

a) a plurality of arms;

b) a plurality of coil springs, wherein each said coil spring is intermediately carried in each said arm;

c) a collar sized to fit over a top end of said stanchion, for holding in a removable manner said arms radially about said stanchion;

d) a plurality of punching bags, wherein each said punching bag is attached to a distal free end of each said arm, to allow for flexibility when each said punching bag is struck by the trainee;

e) said stanchion having a plurality of longitudinally spaced apart adjustment holes; and f) a lock pin in said collar which can engage with any one of said adjustment holes, so as to adjust the height of said punching bags with respect to said stanchion to accommodate the trainee.

10. A multifunctional training device in kit form as recited in claim 1, wherein said T-bar unit includes:

a) an arm having a forked end with two prongs and three hand grips on each said prong, said first hand grip facing upward, said second hand grip facing directly ahead and said third hand grip facing outward;

b) a collar sized to fit over a top end of said stanchion for holding in a removable manner said arm horizontally out from said stanchion;

c) said stanchion having a plurality of longitudinally spaced apart adjustment holes; and d) a lock pin in said collar which can engage with any one of said adjustment holes, so as to adjust the height of said hand grips with respect to said stanchion to accommodate the trainee, whereby when said collar is retained in a lower position on said stanchion, the trainee can do leg raise and dip exercises for chest and triceps, when said collar is retained in an upper position on said stanchion, the trainee can do biceps, shoulder and back pull-ups.

11. A multifunctional training device in kit form as recited in claim 2, wherein said speed bag unit includes:

a) an arm;

b) a collar sized to fit over a top end of said stanchion for holding in a removable manner said arm horizontally out from said stanchion;

c) a back board vertically affixed to a distal free end of said arm;

d) a speed bag suspended on said back board;

e) said stanchion having a plurality of longitudinally spaced apart adjustment holes; and f) a lock pin in said collar which can engage with any one of said adjustment holes, so as to adjust the height of said speed bag with respect to said stanchion to accommodate the trainee.

12. A multifunctional training device in kit form as recited in claim 1, further including a shadow boxing strength trainer unit removably attachable onto said stanchion, so that the trainee can do arm extenuation exercises both for direct forward, extend downward and upward arm flex exercises, so as to primarily imitate shadow boxing movements instead of simply punching at wind.

13. A multifunctional training device in kit form as recited in claim 12, wherein said shadow boxing strength trainer unit includes:

a) an arm;

b) a collar sized to fit over a top end of said stanchion for holding in a removable manner said arm horizontally out from said stanchion;

c) a cross bar transversely affixed to a distal free end of said arm;

d) a pair of elastic expansion cords, each said cord affixed at a first end and at a right angle to one end of said cross bar;

e) a pair of half shaped gloves, each said glove affixed to a second end of one said cord to be engaged by said trainee;

f) said stanchion having a plurality of longitudinally spaced apart adjustment holes; and g) a lock pin in said collar which can engage with any one of said adjustment holes, so as to adjust the height of said gloves on said cords to accommodate the trainee.

14. A multifunctional training device in kit form as recited in claim 1, further including a wrist and forearm strengthener unit removably attachable onto said stanchion, that will enable the trainee to strengthen the wrists and forearms.

15. A multifunctional training device in kit form as recited in claim 14, wherein said wrist and forearm strengthener unit includes.

a) an arm;

b) a collar sized to fit over a top end of said stanchion for holding in a removable manner said arm horizontally out from said stanchion;

c) a pair of spring biased rotatable hand grips transversely affixed to a distal free end of said arm to be gripped and turned forward and backward by the trainee;

d) said stanchion having a plurality of longitudinally spaced apart adjustment holes; and e) a lock pin in said collar which can engage with any one of said adjustment holes, so as to adjust the height of said hand grips to accommodate the trainee.

16. A multifunctional training device in kit form comprising:

a) a base adapted to be placed upon a horizontal support surface;

b) a stanchion;

c) a main coil spring having two ends, in which said first end is fixedly attached to said base, while said second end is fixedly attached to said stanchion;

d) a body bag unit removably attachable onto said stanchion to receive strikes from a trainee;

e) a punching bag striking unit removably attachable onto a top end of said stanchion to receive strikes from the trainee;

f) a T-bar unit removably attachable onto a top end of said stanchion, so that the trainee can do pull-up exercises for the chest and back; and g) a spring immobilizer which fits about said main coil spring to maintainsaid stanchion in a vertical upright stationary position, to allow the trainee to use said T-bar unit safely.

17. A multifunctional training device in kit form as recited in claim 16, further including a speed bag unit removably attachable onto a top end of said stanchion to receive punches from the trainee.

18. A multifunctional training device in kit form as recited in claim 17, wherein said base includes:

a) a platform which sits upon the horizontal support surface;

b) a stub post having a mounting flange at a bottom end and an annular seat at a top end; and c) a plurality of fasteners to affix said mounting flange centrally to said platform, so that said top annular seat can be fixedly attached to said first end of said main coil spring.

19. A multifunctional training device in kit form as recited in claim 18, wherein said stanchion is an elongate cylindrical pipe having an annular seat at a bottom end, so that said bottom annular seat can be fixedly attached to said second end of said main coil spring.

20. A multifunctional training device in kit form as recited in claim 19, wherein said body bag unit is curved in shape similar to a human torso with sides, back and front being identical, to give better leverage to the trainee with uppercuts and hooks to the body, unlike a traditional rounded body bag.

21. A multifunctional training device in kit form as recited in claim 20, wherein said punching bag striking unit includes:

a) a plurality of arms;

b) a plurality of coil springs, wherein each said coil spring is intermediately carried in each said arm;

c) a cap sized to fit upon at top end of said stanchion for securing in a removable manner said arms radially about the top end of said stanchion; and d) a plurality of punching bags, wherein each said punching bag is attached to a distal free end of each said arm, to allow for flexibility and freedom of movement for the trainee around said punching bag striking unit, providing the impression of an opponent's head being available at all angles, which when struck, imitates natural head movements.

22. A multifunctional training device in kit form as recited in claim 21, further including:

a) said stanchion having a plurality of longitudinally spaced apart adjustment holes;

b) an elongate sleeve extending centrally through said body bag unit and affixed thereto, whereby said elongate sleeve can slide upon said stanchion; and c) a lock pin in said elongate sleeve which can engage with any one of said adjustment holes, so as to adjust the height of said body bag unit with respect to said stanchion to accommodate the trainee, said body bag unit is also removable, so that each of said other units can be used without said body bag unit being attached onto said stanchion.

23. A multifunctional training device in kit form as recited in claim 22, wherein said T-bar unit includes:

a) a pair of arms;

b) a cap sized to fit upon a top end of said stanchion for securing in a removable manner said arms in an opposed position radially about the top end of said stanchions;

c) a pair of flexible cords, whereby each said flexible cord will hang down from a distal free end of each said arm and ;

d) a pair of rings, whereby each said ring is affixed to one said flexible cord.

24. A multifunctional training device in kit form as recited in claim 20, wherein said punching bag striking unit includes:

a) a plurality of arms;

b) a plurality of coil springs, wherein each said coil spring is intermediately carried in each said arm;

c) a collar sized to fit over a top end of said stanchion, for holding in a removable manner said arms radially about said stanchion;

d) a plurality of punching bags, wherein each said punching bag is attached to a distal free end of each said arm, to allow for flexibility when each said punching bag is struck by the trainee;

e) said stanchion having a plurality of longitudinally spaced apart adjustment holes; and f) a lock pin in said collar which can engage with any one of said adjustment holes, so as to adjust the height of said punching bags with respect to said stanchion to accommodate the trainee.

25. A multifunctional training device in kit form as recited in claim 24, wherein said T-bar unit includes:

a) an arm having a forked end with two prongs and three hand grips on each said prong, said first hand grip facing upward, said second hand grip facing directly ahead and said third hand grip facing outward;

b) a collar sized to fit over a top end of said stanchion for holding in a removable manner said arm horizontally out from said stanchion;

c) said stanchion having a plurality of longitudinally spaced apart adjustment holes; and d) a lock pin in said collar which can engage with any one of said adjustment holes, so as to adjust the height of said hand grips with respect to said stanchion to accommodate the trainee, whereby when said collar is retained in a lower position on said stanchion, the trainee can do leg raise and dip exercises for chest and triceps, when said collar is retained in an upper position on said stanchion, the trainee can do biceps, shoulder and back pull-ups.

26. A multifunctional training device in kit form as recited in claim 25, wherein said speed bag unit includes:

a) an arm;

b) a collar sized to fit over a top end of said stanchion for holding in a removable manner said arm horizontally out from said stanchion;

c) a back board vertically affixed to a distal free end of said arm;

d) a speed bag suspended on said back board;

e) said stanchion having a plurality of longitudinally spaced apart adjustment holes; and f) a lock pin in said collar which can engage with any one of said adjustment holes, so as to adjust the height of said speed bag with respect to said stanchion to accommodate the trainee.

27. A multifunctional training device in kit form as recited in claim 20, further including a shadow boxing strength trainer unit removably attachable onto said stanchion, so that the trainee can do arm extenuation exercises both for direct forward, extend downward and upward arm flex exercises, so as to primarily imitate shadow boxing movements instead of simply punching at wind.

28. A multifunctional training device in kit form as recited in claim 27, wherein said shadow boxing strength trainer unit includes:

a) an arm;

b) a collar sized to fit over a top end of said stanchion for holding in a removable manner said arm horizontally out from said stanchion;

c) a cross bar transversely affixed to a distal free end of said arm;

d) a pair of elastic expansion cords, each said cord affixed at a first end and at a right angle to one end of said cross bar;

e) a pair of half shaped gloves, each said glove affixed to a second end of one said cord to be engaged by said trainee;

f) said stanchion having a plurality of longitudinally spaced apart adjustment holes; and g) a lock pin in said collar which can engage with any one of said adjustment holes, so as to adjust the height of said gloves on said cords to accommodate the trainee.

29. A multifunctional training device in kit form as recited in claim 28, further including a wrist and forearm strengthener unit removably attachable onto said stanchion, that will enable the trainee to strengthen the wrists and forearms.

30. A multifunctional training device in kit form as recited in claim 29, wherein said wrist and forearm strengthener unit includes:

a) an arm;

b) a collar sized to fit over a top end of said stanchion for holding in a removable manner said arm horizontally out from said stanchion;

c) a pair of spring biased rotatable hand grips transversely affixed to a distal free end of said arm to be gripped and turned forward and backward by the trainee;

d) said stanchion having a plurality of longitudinally spaced apart adjustment holes; and e) a lock pin in said collar which can engage with any one of said adjustment holes, so as to adjust the height of said hand grips to accommodate the trainee.

31. A multifunctional training device in kit form comprising:

a) a base adapted to be placed upon a horizontal support surface;

b) a stanchion;

c) a main coil spring having two ends, in which said first end is fixedly attached to said base, while said second end is fixedly attached to said stanchion;

d) a body bag unit removably attachable onto said stanchion to receive strikes from a trainee;

e) a punching bag striking unit removably attachable onto a top end of said stanchion to receive strikes from the trainee.

f) a T-bar unit removably attachable onto a top end of said stanchion so that the trainee can do pull-up exercises for the chest and back; and g) a tension adjuster for said main coil spring, so as to control movement of said stanchion with respect to said base, wherein said tension adjuster includes:

a) a knurled collar rotatively carried on a top end of a hollow stub post of said base, said knurled collar having an internally threaded aperture; and b) a spring support collar having an externally threaded circumference that threads into said knurled collar, so that when said knurled collar is turned it will raise and lower said spring support collar to effectively increase and reduce spring action of said main coil spring, which extends into said hollow stub post.

* * * * *